US007011555B2

(12) United States Patent
Pan

(10) Patent No.: US 7,011,555 B2
(45) Date of Patent: Mar. 14, 2006

(54) BOARD-TO-BOARD CONNECTOR AND ASSEMBLY OF PRINTED CIRCUIT BOARDS

(75) Inventor: Long-Jyh Pan, Hsi Chih (TW)

(73) Assignee: Benq Corporation, Taoyuan (TW)

( * ) Notice: Subject to any disclaimer, the term of this patent is extended or adjusted under 35 U.S.C. 154(b) by 0 days.

(21) Appl. No.: 10/973,712

(22) Filed: Oct. 26, 2004

(65) Prior Publication Data

US 2005/0101165 A1 May 12, 2005

(30) Foreign Application Priority Data

Nov. 7, 2003 (TW) ..... 92131229 A

(51) Int. Cl.
*H01R 4/48* (2006.01)

(52) U.S. Cl. ..... 439/862; 439/79; 439/66; 439/289

(58) Field of Classification Search ..... 439/79, 439/289–290, 66, 862
See application file for complete search history.

(56) References Cited

U.S. PATENT DOCUMENTS 6,273,731 B1 * 8/2001 Bishop et al. ..... 439/66

* cited by examiner

*Primary Examiner*—Truc Nguyen
(74) *Attorney, Agent, or Firm*—Ladas and Parry LLP

(57) ABSTRACT

A board-to-board connector is disposed between and interconnects two printed circuit boards electrically in such a manner that once a slight misalignment occurs therebetween the electrical connection thereof is unaffected by virtue of predetermined positionally limiting relationship between the holding and mounting members of plug and clamp bodies of the connector.

17 Claims, 7 Drawing Sheets

BOARD-TO-BOARD CONNECTOR AND ASSEMBLY OF PRINTED CIRCUIT BOARDS

FIELD OF THE INVENTION

The invention relates to a connector, more particularly to a board-to-board connector for interconnecting electrically two printed circuit boards.

BACKGROUND OF THE INVENTION

The printed circuit boards are electrically connected to one another by connectors in two different types, i.e., side-by-side connection or parallel connection. In case fasteners, such as screws, are used to position two printed circuit boards in parallel connection and an electrical connector is disposed between and contact the circuit boards in point-to-point manner so as to form an electrical connection between the circuit boards. Under this condition, the vertical distance between the circuit boards is fixed. A slight misalignment resulting from an external force applied onto one of the circuit boards or deformation of an angular position of the electrical connector interconnecting the circuit boards may cause loss of electrical connection between the adjacent printed circuit boards. The reason resides in that the electrical connector cannot provide a sufficient buffering force to prevent the circuit boards disengaging from one another.

It is therefore inevitably necessary from an inventor' view point to provide a board-to-board connector which is adapted to electrically interconnect two printed circuit boards and which is adapted to tolerate position error due to slight misalignment between the circuit boards.

SUMMARY OF THE INVENTION

The object of the present invention is to provide a board-to-board connector that is adapted to electrically interconnect two oppositely disposed printed circuit boards and that can eliminate the aforesaid disadvantage resulting from use of a prior art electrical connector.

In one aspect of the present invention, a board-to-board connector is provided to include: a plug body formed as a fishbone structure, and having two positioning faces at two outer sides thereof which are opposed along an axis of the fishbone structure, each of the positioning faces having a mounting member, the plug body further having a plurality of parallel finger-receiving slots between the positioning faces and a plurality of extension rooms which are communicated respectively with the finger-receiving slots and which are wider than the finger-receiving slots, respectively; a plurality of resilient gold fingers, each of the gold fingers being mounted in a respective one of the finger-receiving slots and a respective one of the extension rooms, and having a fixing part protruding into the respective one of the extension rooms, a contact part protruding outwardly from the respective one of the finger-receiving slots, and an intermediate part that is located between the fixing and contact parts and that is formed as a bent configuration; and a clamp body for externally clamping the plug body, and including a pair of clamping elements and a pair of fastening elements extending respectively away from the clamping elements, each of the clamping elements having a holding member to make a predetermined positionally limited relationship with a corresponding one of the mounting members. When the clamp body clamps the plug body, the holding members on the clamping elements make the predetermined positionally limited relationship with the mounting members while the contact parts of the gold fingers extend outward from one side of the clamp body which has the fastening elements.

In anther aspect of the present invention, an assembly of printed circuit boards is provided to include: a first printed circuit board having a plurality of first contact pins; a second printed circuit board having a plurality of second contact pins, wherein the first and second contact pins are arranged in face-to-face manner and are disposed to be opposite to one another; and a board-to-board connector disposed between the first and second printed circuit boards in a parallel manner for electrically connecting the first and second printed circuit boards. The board-to-board connector includes: a plug body formed as a fishbone structure, and having a first face adjacent to the first printed circuit board, a second face adjacent to the second printed circuit board, two positioning faces at two outer sides thereof which are opposed along an axis of the fishbone structure, each of the positioning faces having a mounting member, the plug body further having a plurality of parallel finger-receiving slots between the positioning faces and a plurality of extension rooms which are communicated respectively with the finger-receiving slots and which are wider than the finger-receiving slots, respectively; a plurality of resilient gold fingers, each of the gold fingers being mounted in a respective one of the finger-receiving slots and a respective one of the extension rooms, and having a fixing part protruding through the first face of the plug body for connecting adhesively with a respective one of said first contact pins of the first printed circuit board, a contact part protruding through the second face of the plug body for contacting a respective one of the second contact pins of the second printed circuit board, and an intermediate part that is located between the fixing and contact parts and that is formed as a bent configuration; and a clamp body mounted securely on the second printed circuit board for clamping the plug body, and including a pair clamping elements, a pair of fastening elements for fastening the second printed circuit board, each of the clamping elements having a holding member to make a predetermined positionally limiting relationship with a corresponding one of the mounting members when the plug body is inserted into the clamp body.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTIONS OF THE PREFERRED EMBODIMENTS

Figure 1:
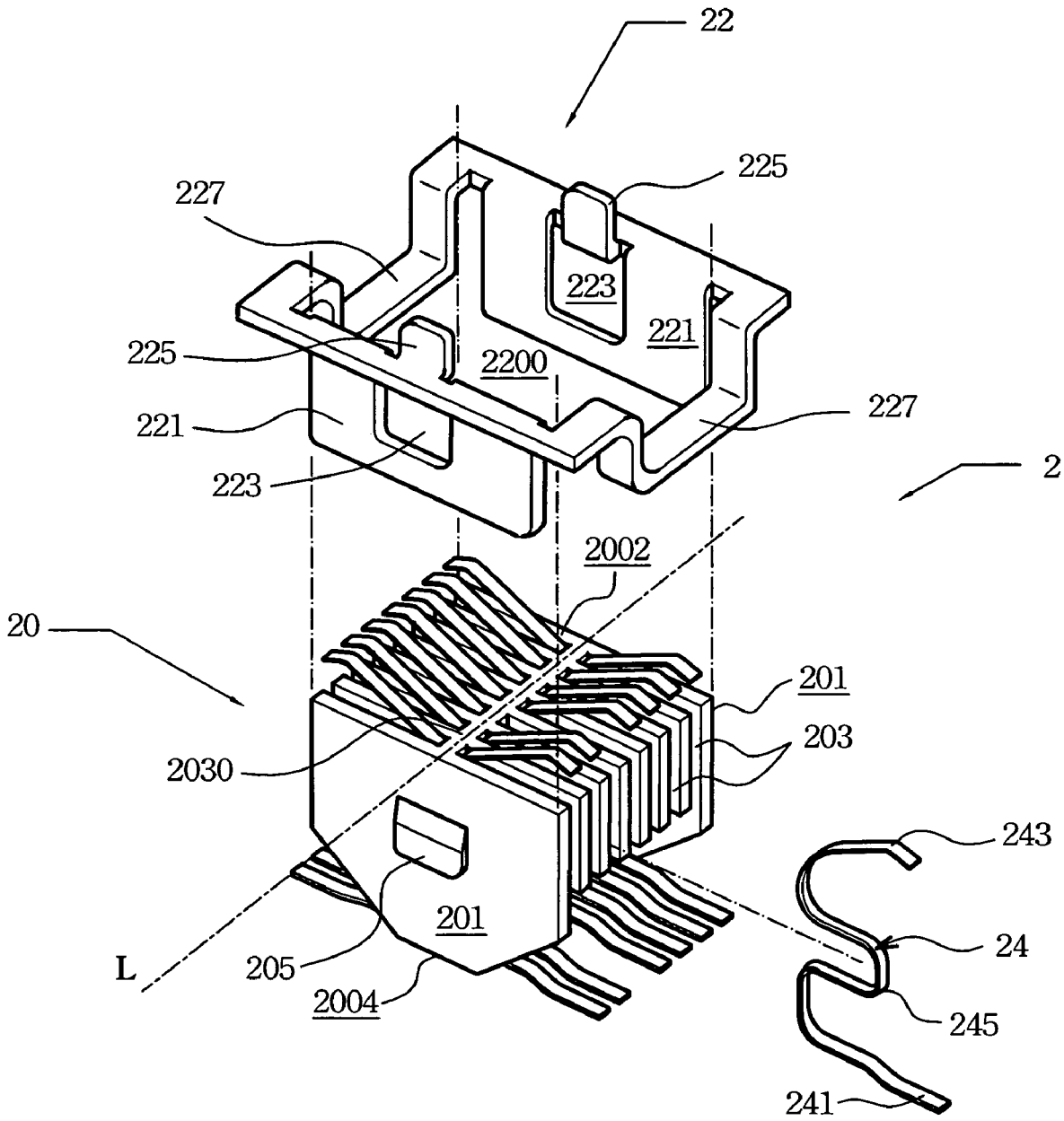
FIG. 1 is an exploded and perspective view of the preferred embodiment of a board-to-board connector according to the present invention.

It should be noted that same reference numerals have been used to denote similar elements throughout the specification.

FIG. 1 shows an exploded view of the preferred embodiment of a board-to-board connector 2 according to the present invention, and includes a plug body 20, a plurality of resilient gold fingers 24 mounted in the plug body 20, and a clamp body 22 into which the plug body 20 is to be inserted.

Figure 2:
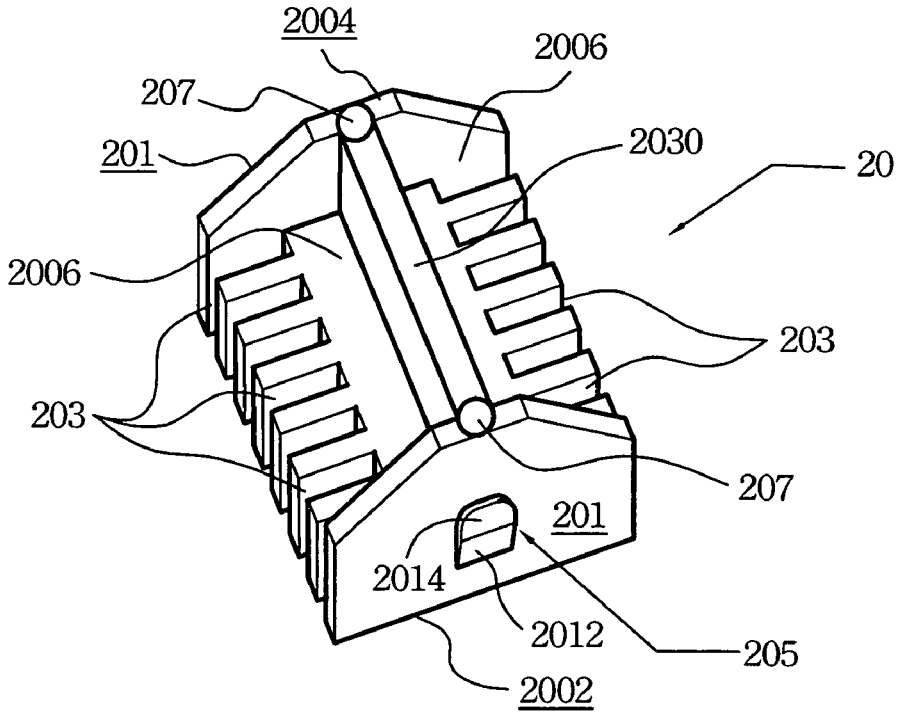
FIG. 2 is a perspective view of a plug body employed in the preferred embodiment of the board-to-board connector according to the present invention.
Figure 4:
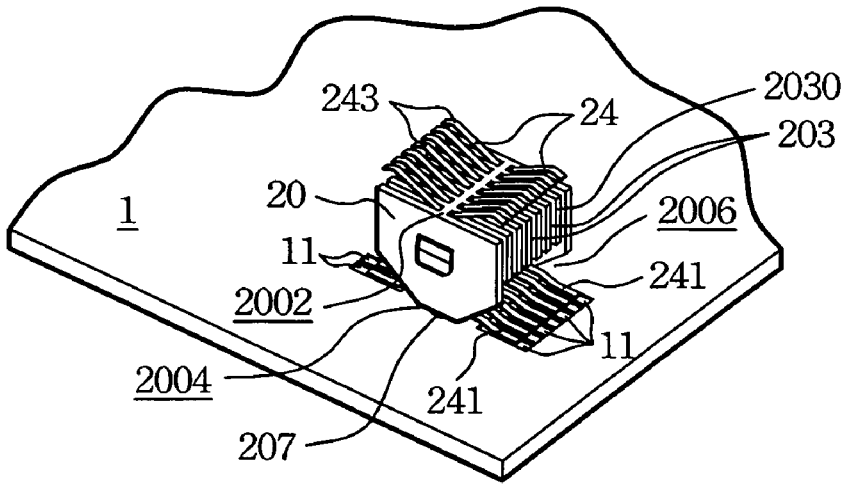
FIG. 4 illustrates how the plug body and the gold fingers of the preferred embodiment of the board-to-board connector according to the present invention are mounted on a first printed circuit board.

Referring to FIGS. 1 and 2 (the plug body 20 is turned upside down), the plug body 20 is formed as a fishbone structure with a central axis 2030, and has two positioning faces 201 at two outer sides thereof which are opposed along the axis 2030 of the fishbone structure. Each of the positioning faces 201 has a mounting member 205. The plug body 20 has a plurality of parallel finger-receiving slots 203 between the positioning faces 201 and an extension room 2006 that is communicated the finger-receiving slots 203 and which is wider than the respective finger-receiving slot 203. Preferably, the plug body 20 further has a first face 2004, a second face 2002 opposite to the first face 2004, and two bulge members 207 which are formed on the first face 2004 and which are respectively adjacent to the positioning faces 201. The bulge members 207 are used to connect with a printed circuit board in point-to-point manner in case the plug body 20 is mounted on the printed circuit board, as best shown in FIGS. 2 and 4.

Figure 3:
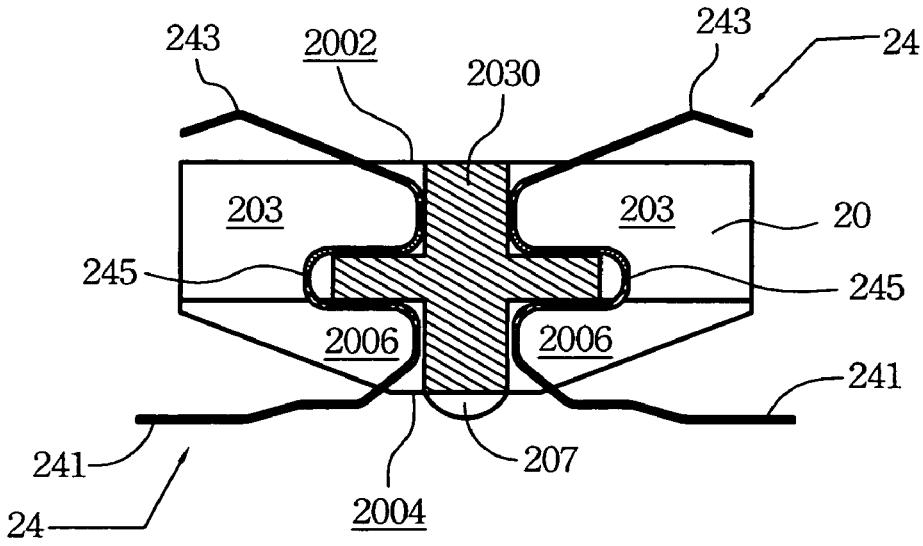
FIG. 3 is a sectional view, illustrating connecting relationship between the plug body and a plurality of gold fingers of the preferred embodiment of the board-to-board connector according to the present invention.

Referring to FIGS. 1 and 3, each of the gold fingers 24 is mounted in a respective one of the finger-receiving slots 203 and the extension room 2006, and has a fixing part 241 protruding into the extension room 2006, a contact part 243 protruding outwardly from the respective finger-receiving slot 203, and an intermediate part 245 that is located between the fixing and contact parts 241, 243 and that is formed as a bent configuration. Note that since the extension room 2006 has a width greater than each of the finger-receiving slots 203, turning and bending actions of the fixing parts 241 of the gold finger within the extension room 2006 are allowable so as to provide a buffering function.

Referring again to FIG. 1, the clamp body 22 is adapted to clamp the plug body 20 externally, and includes a pair of clamping elements 221 and a pair of fastening elements 225 extending respectively away from the clamping elements 221. Each of the clamping elements 221 has a holding member 223 to make a predetermined positionally limited relationship with a corresponding one of the mounting members 205. When the clamp body 22 clamps the plug body 20 externally, the holding members 223 on the clamping elements 221 make the predetermined positionally limited relationship with the mounting members 205. The contact parts 243 of the gold fingers 24 extend outward from one side of the clamp body 22 that has the fastening elements 225 via the respective finger-receiving slots 203 (see FIG. 3). The fixing parts 41 of the gold fingers 24 protrude into the extension room 2006. As to how the holding member 223 and the mounting members 205 cooperatively make the predetermined positionally limited relationship therebetween will be described in detail in the following paragraphs.

In this preferred embodiment, the finger-receiving slots 203 and the extension room 2006 are located on the same side of the fishbone structure. The clamp body 22 is configured as a frame structure for insertion of the plug body 20, and has two auxiliary limiting arms 227 interconnecting opposite ends of the clamping elements 221. The mounting members 205 of the plug body 20 are projection members that protrude outwardly and respectively from the positioning faces 201 (see FIG. 1), and includes an inner bent portion 2012 and an outer flat portion 2014 (see FIG. 2). The holding members 223 of the clamp body 22 are preferably through bores (see FIG. 1) to mate with the projection members.

Figure 9:
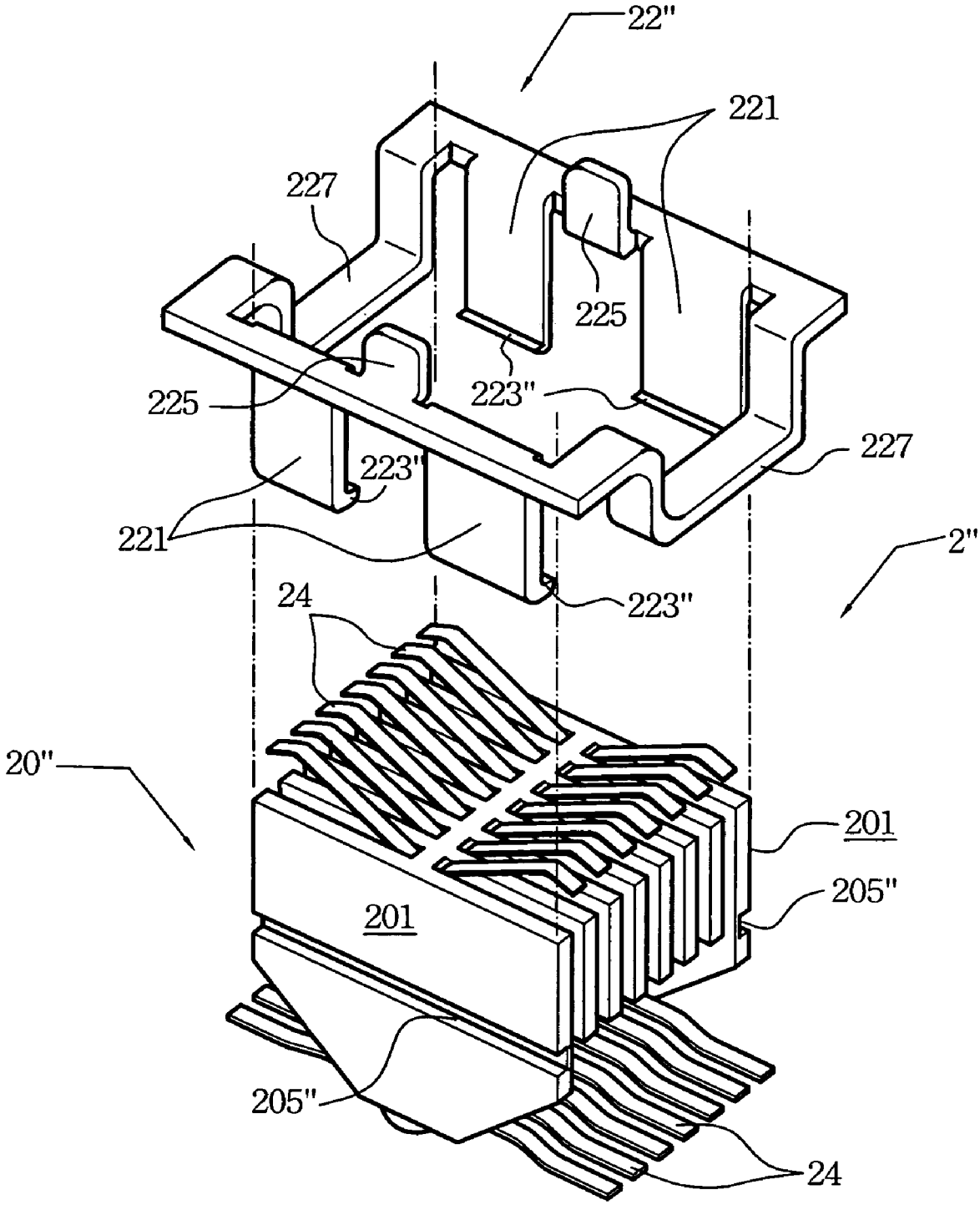
FIG. 9 is an exploded and perspective view, illustrating modified plug and clamp bodies of the preferred embodiment of an assembly of printed circuit boards according to the present invention.

Referring to FIG. 9, in one preferred embodiment of a board-to-board connector 2 of the present invention, the mounting members 205" of the plug body 20" are two opposite grooves which are respectively formed on the positioning faces 201. The holding members 223" of the clamp body 22" are formed as hooks to engage the grooves, respectively. Each of the fastening elements 225 of the clamp body 22" is a stamped positioning tongue structure for inserting through a mounting bore 33 (see FIG. 5) formed through a printed circuit board 3 for mounting of the same on the circuit board 3.

Figure 10:
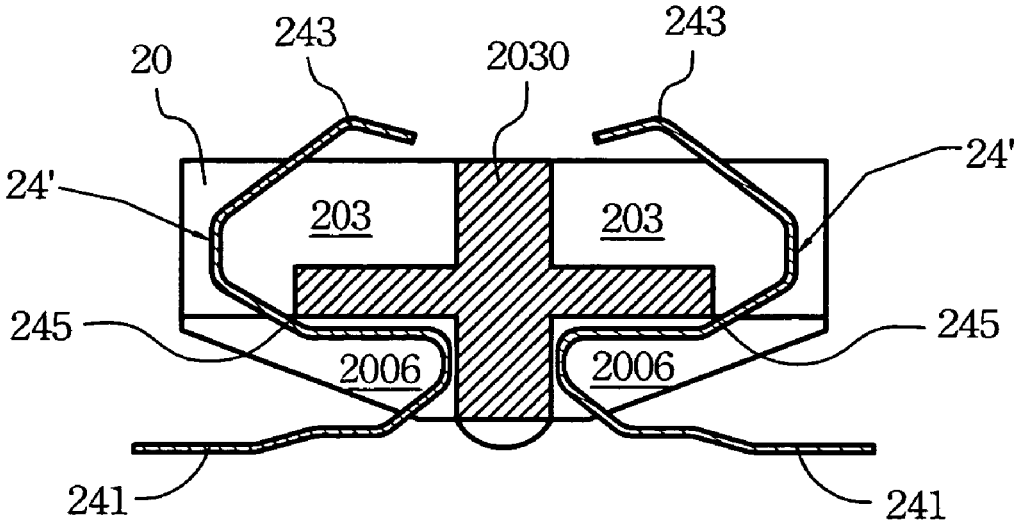
FIG. 10 is a sectional view, illustrating a modified gold finger of the preferred embodiment of an assembly of printed circuit boards according to the present invention.

FIG. 10 illustrates one preferred embodiment of a board-to-board connector 2 of the present invention which is similar to that shown in FIG. 1. The only difference resides in a modified gold finger 24' which has an intermediate part 245 with a bent configuration different from that shown in FIG. 1.

Figure 11:
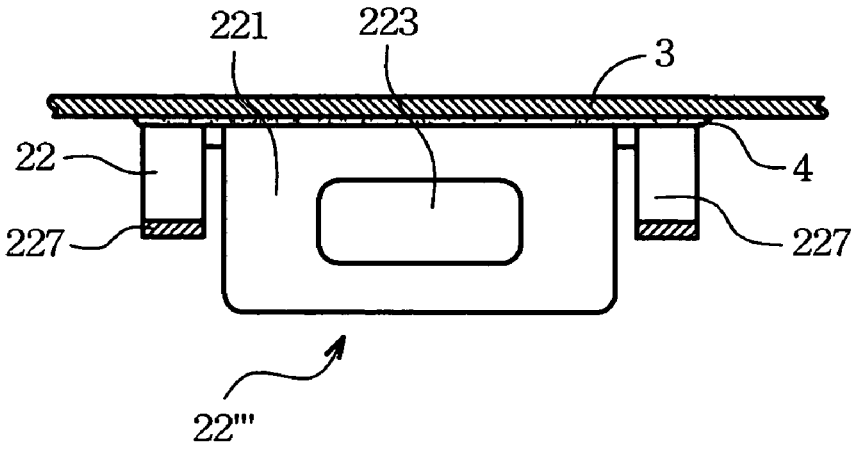
FIG. 11 is a fragmentary partly sectional view, illustrating how a clamp body is mounted on a printed circuit board of the preferred embodiment of an assembly of printed circuit boards according to the present invention.

Referring to FIG. 11, in one preferred embodiment of a board-to-board connector 2 of the present invention, the fastening elements of the clamp body 22 are adhesive layers 4 which are attached to a printed circuit board 3 for mounting of the clamp body 22 on the printed circuit board 3.

Figure 12:
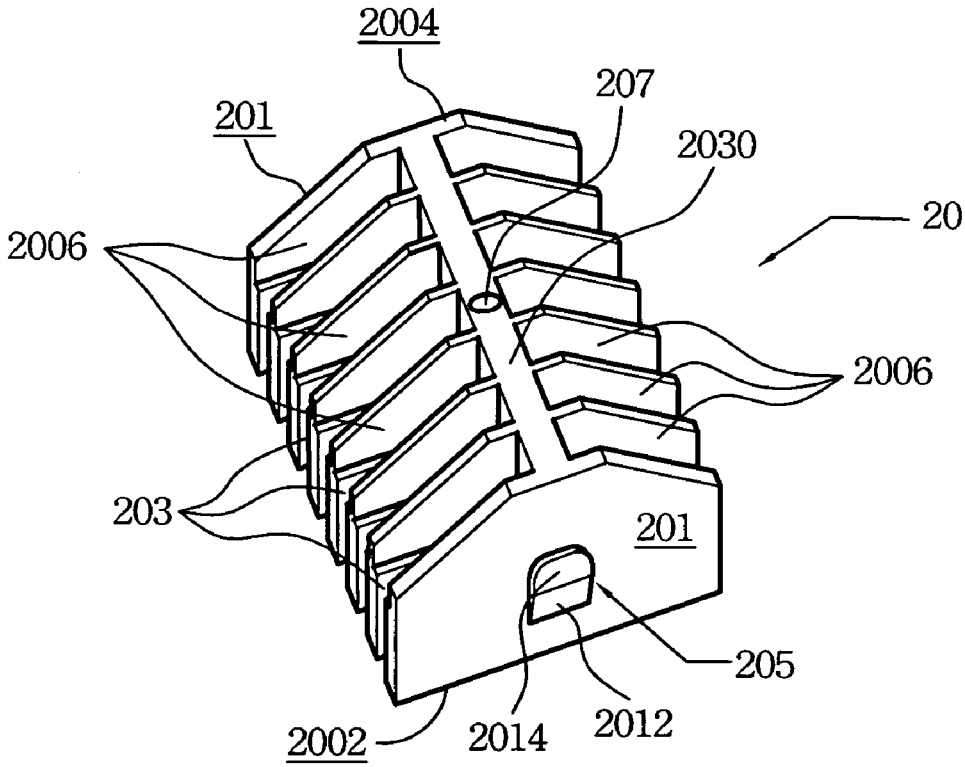
FIG. 12 is a perspective view of a modified plug body employed in the preferred embodiment of an assembly of printed circuit boards according to the present invention.

Referring to FIG. 12, in one preferred embodiment of a board-to-board connector 2 of the present invention, the plug body 20 includes a plurality of the extension rooms 2006, each of which is in spatial communication with a respective one of the finger-receiving slots 203 and each of which has a width greater than the respective one of the finger-receiving slots 203.

Figure 6:
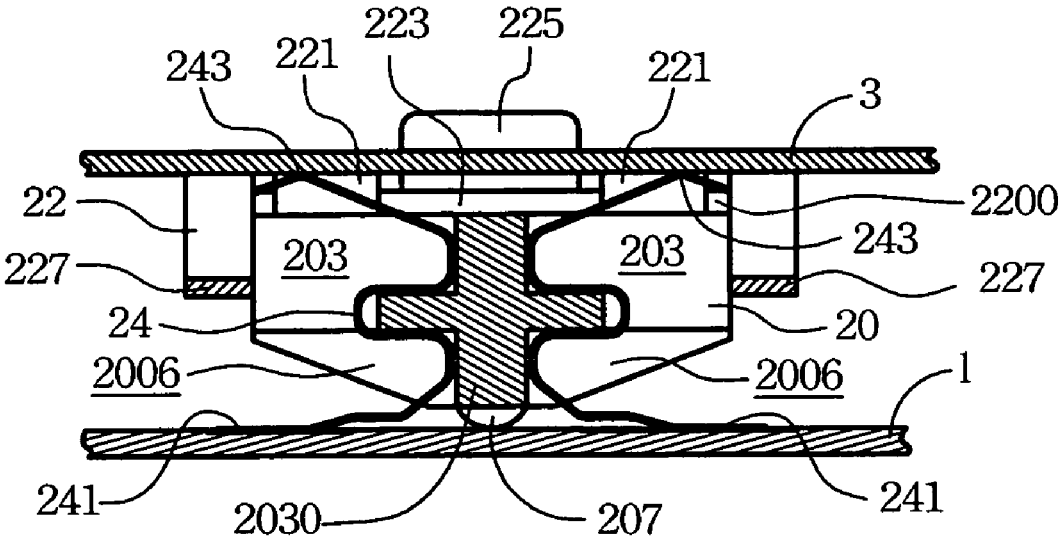
FIG. 6 is a sectional view of the preferred embodiment of an assembly of printed circuit boards according to the present invention.

An assembly of printed circuit boards according to the present invention is shown in FIG. 6 to include a board-to-board connector 2 which is disposed between two parallel printed circuit boards 1, 3 and which interconnects the printed circuit boards 1, 3 electrically.

As illustrated in FIG. 4, the plug body 20 has a first face 2004 adjacent to the first printed circuit board 1, a second face 2002 adjacent to the second printed circuit board 3 and opposite to the first face 2004, two positioning faces 201 at two outer sides thereof which are opposed along the axis 2030 of the fishbone structure. The gold fingers 24 are respectively mounted in the finger-receiving slots 203 and the extension rooms 2006 in a manner disclosed in the aforesaid paragraphs, and have fixing parts 241 protruding through the first face 2004 of the plug body 20 for connecting respectively with the first contact pins 11 of the first printed circuit board 1, and contact parts 243 protruding through the second face 2002 of the plug body 20. The fixing parts 241 of the gold fingers 24 can be soldered respectively to the first contact pins 11 by surface mount technique. Alternately, the fixing parts 241 of the gold fingers 24 contact respectively the first contact pins 11 so long as there is an electrical connection therebetween.

Figure 5:
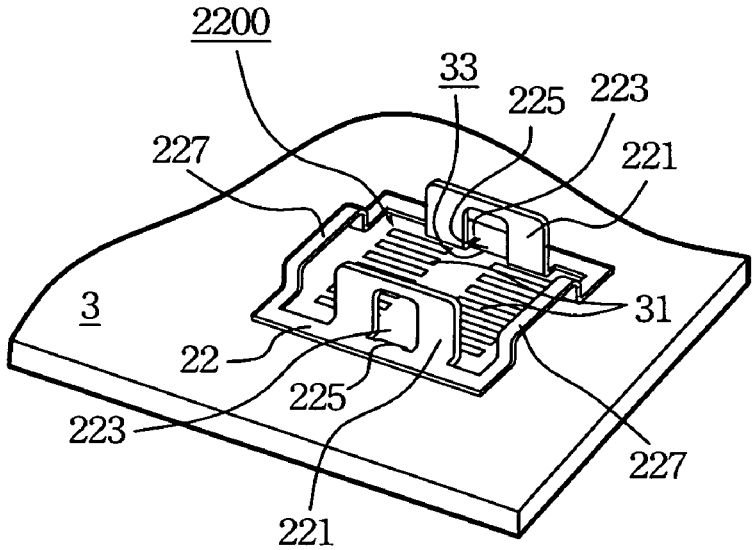
FIG. 5 illustrates how a clamp body of the preferred embodiment of the board-to-board connector according to the present invention is mounted on a second printed circuit board.
Figure 7:
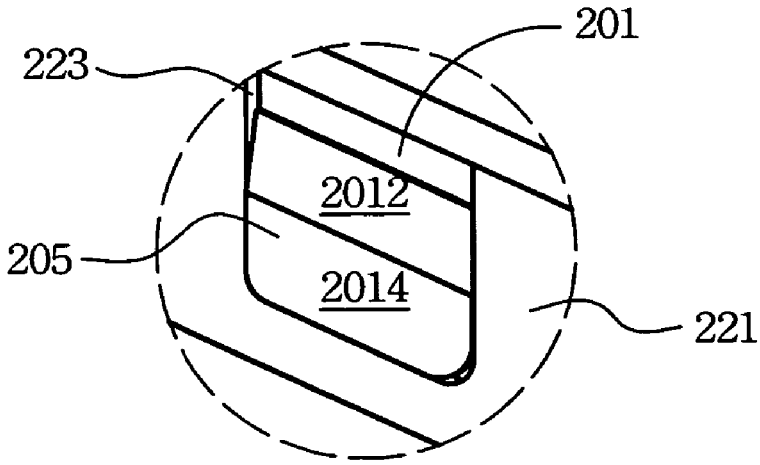
FIG. 7 is an enlarged portion, illustrating a predetermined positionally limited relationship between a plug body and a clamp body of the preferred embodiment an assembly of printed circuit boards according to the present invention.
Figure 8:
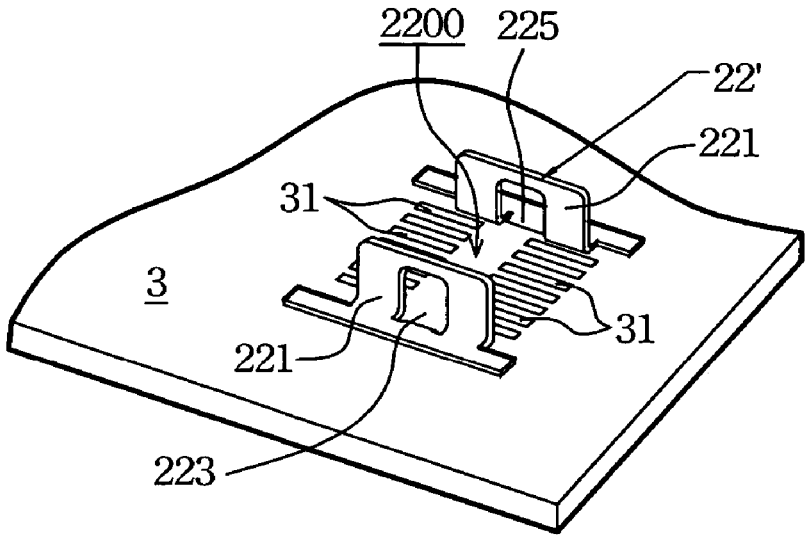
FIG. 8 is a fragmentary perspective view, illustrating a modified clamp body of the preferred embodiment of an assembly of printed circuit boards according to the present invention.

Referring to FIG. 5, the clamp body 22 is mounted securely on the second printed circuit board 3 by inserting the fastening elements 225 through the mounting bores 33 of the second printed circuited 3 so as to prevent disengagement therebetween. The plug body 20 is then inserted into the clamp body 22 in such a manner that the contact parts 243 of the gold fingers 24 are confined within a space 2200 (see FIG. 6) defined by the auxiliary limiting arms 227 of the clamp body 22, extend through the second face 2002 of the clamp body 22 to contact the second contact pins 31 of the second printed circuit board 3, respectively, while the fixing parts 241 thereof respectively contact the first contact pins 11 of the first printed circuit board 1, thereby establish an electrical connection between the first and second printed circuit boards 1, 3. Preferably, the mounting bores 33 are formed through the second printed circuit board 3 and are disposed at a position midway of two rows of the second contact pins 3. After assembly, the mounting members 205 of the plug body 20 extend through the holding members 223 of the clamp body 22 so to form a slidable engagement between the holding members 223 and the mounting members 205 (see FIG. 7), which in turn, permits slight misalignment between the printed circuit boards 1, 3 in vertical or horizontal directions without affecting electrical connection therebetween by virtue of and presence of so called "predetermined positionally limiting relationship". In addition, the misalignment between the printed circuit boards 1, 3 is further enhanced since the fixing parts 241 and the contact parts 243 of the gold fingers 24 can be deformed in the vertical direction due to extension of the fixing parts 241 into the extension rooms 2006 while the contact parts 243 thereof protrude outwardly from one side of the clamp body 22 having the fastening elements 225.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A board-to-board connector comprising:

a plug body formed as a fishbone structure, and having two positioning faces at two outer sides thereof which are opposed along an axis of said fishbone structure, each of said positioning faces having a mounting member, said plug body further having a plurality of parallel finger-receiving slots between said positioning faces and a extension room which is communicated with said finger-receiving slots and which is wider than said finger-receiving slots;

a plurality of resilient gold fingers, each of said gold fingers being mounted in a respective one of said finger-receiving slots and a respective one of said extension rooms, and having a fixing part protruding into the respective one of said extension rooms, a contact part protruding outwardly from the respective one of said finger-receiving slots, and an intermediate part that is located between said fixing and contact parts and that is formed as a bent configuration; and a clamp body for externally clamping said plug body, and including a pair of clamping elements and a pair of fastening elements extending respectively away from said clamping elements, each of said clamping elements having a holding member to make a predetermined positionally limited relationship with a corresponding one of said mounting members;

wherein, when said clamp body clamps said plug body, said holding members on said clamping elements make said predetermined positionally limited relationship with said mounting members, said contact parts of said gold fingers extending outward from one side of said clamp body which has said fastening elements.

2. The board-to-board connector according to claim 1, wherein said extension rooms which correspond to said finger-receiving slots are spatially communicated with one another.

3. The board-to-board connector according to claim 1, wherein said finger-receiving slots and corresponding ones of said extension rooms are located on the same side of the fishbone structure.

4. The board-to-board connector according to claim 1, wherein said clamp body is configured as a frame structure for insertion of said plug body, and has two auxiliary limiting arms interconnecting opposite ends of said clamping elements.

5. The board-to-board connector according to claim 1, wherein said mounting members of said plug body are projection members that protrude outwardly and respectively from said positioning faces, said holding members of said clamp body being through bores to mate with said projection members.

6. The board-to-board connector according to claim 1, wherein said mounting members of said plug body are two opposite grooves which are respectively formed on said positioning faces, said holding members of said clamp body are formed as hooks to engage said grooves, respectively.

7. The board-to-board connector according to claim 1, wherein each of said fastening elements of said clamp body is a stamped positioning tongue structure.

8. The board-to-board connector according to claim 1, wherein said fastening elements of said clamp body are adhesive layers.

9. An assembly of printed circuit boards, comprising:

a first printed circuit board having a plurality of first contact pins;

a second printed circuit board having a plurality of second contact pins, wherein said first and second contact pins are arranged in face-to-face manner and are disposed to be opposite to one another; and a board-to-board connector disposed between said first and second printed circuit boards in a parallel manner for electrically connecting said first and second printed circuit boards and including a plug body formed as a fishbone structure, and having a first face adjacent to said first printed circuit board, a second face adjacent to said second printed circuit board, two positioning faces at two outer sides thereof which are opposed along an axis of said fishbone structure, each of said positioning faces having a mounting member, said plug body further having a plurality of parallel finger-receiving slots between said positioning faces and a plurality of extension rooms which are communicated respectively with said finger-receiving slots and which are wider than said finger-receiving slots, respectively, a plurality of resilient gold fingers, each of said gold fingers being mounted in a respective one of said finger-receiving slots and a respective one of said extension rooms, and having a fixing part protruding through said first face of said plug body for connecting with a respective one of said first contact pins of said first printed circuit board, a contact part protruding through said second face of said plug body for contacting a respective one of said second contact pins of said second printed circuit board, and an intermediate part that is located between said fixing and contact parts and that is formed as a bent configuration, and a clamp body mounted securely on said second printed circuit board for clamping said plug body, and including a pair clamping elements extending toward said first printed circuit board, a pair of fastening elements for fastening said second printed circuit board, each of said clamping elements having a holding member to make a predetermined positionally limiting relationship with the corresponding one of said mounting members when said plug body is inserted into the clamp body.

10. The assembly of printed circuit boards according to claim 9, wherein said extension rooms are defined between said finger-receiving slots and said first printed circuit board, each of said extension rooms being in spatial communication with a corresponding one said finger-receiving slots.

11. The assembly of printed circuit boards according to claim 9, wherein said finger-receiving slots and said extension rooms are located on the same side of the fishbone structure.

12. The assembly of printed circuit boards according to claim 9, wherein said clamp body is configured as a frame structure for insertion of said plug body, and has two auxiliary limiting arms interconnecting opposite ends of said clamping elements.

13. The assembly of printed circuit boards according to claim 9, wherein said mounting members of said plug body are projection members that protrude outwardly and respectively from said positioning faces, said holding members of said clamp body being through bores to mate with said projection members, respectively.

14. The assembly of printed circuit boards according to claim 9, wherein said mounting members of said plug body are two opposite grooves which are respectively formed on said positioning faces, said holding members of said clamp body are formed as hooks to engage said grooves, respectively.

15. The assembly of printed circuit boards according to claim 9, wherein each said fastening elements of said clamp body is stamped positioning tongue structure and is insert through said second printed circuit board.

16. The assembly of printed circuit boards according to claim 9, wherein said fastening elements of said clamp body are adhesive layers which are adhesively secured to said second printed circuit board.

17. The assembly of printed circuit boards according to claim 9, wherein said plug body further includes at least one bulge member that is fixed on said second face and that extends toward and contacts said first printed circuit board in point-to-point manner.

* * * * *